US011511914B2

(12) United States Patent
Hansen et al.

(10) Patent No.: US 11,511,914 B2
(45) **Date of Patent: *Nov. 29, 2022**

(54) HIDDEN FLANGE CHILD RESISTANT CLOSURE FOR RECLOSEABLE POUCH AND METHODS

(71) Applicant: Reynolds Presto Products Inc., Lake Forest, IL (US)

(72) Inventors: William Bradford Hansen, Appleton, WI (US); Andrew R. Austreng, Appleton, WI (US)

(73) Assignee: Reynolds Presto Products Inc., Lake Forest, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/332,665

(22) Filed: May 27, 2021

(65) Prior Publication Data

US 2021/0284394 A1 Sep. 16, 2021

Related U.S. Application Data

(63) Continuation of application No. 16/851,866, filed on Apr. 17, 2020, now Pat. No. 11,292,638, which is a continuation of application No. 16/550,872, filed on Aug. 26, 2019, which is a continuation-in-part of (Continued)

(51) Int. Cl.
*B65D 33/25* (2006.01)

(52) U.S. Cl.
CPC ..... *B65D 33/2508* (2013.01)

(58) Field of Classification Search
CPC .. B65D 33/2508; B65D 23/102; B65D 27/36; B65D 2251/00; B65D 2517/5072
See application file for complete search history.

(56) References Cited

U.S. PATENT DOCUMENTS 2,916,197 A 12/1959 Detrie et al.
4,410,130 A 10/1983 Herrington
4,528,224 A 7/1985 Ausnit
(Continued)

FOREIGN PATENT DOCUMENTS

CN 107074405 A 8/2017
EP 985605 A2 3/2000
(Continued)

OTHER PUBLICATIONS

International Search Report and Written Opinion for Application No. PCT/US2019/065240 dated Mar. 11, 2020, 17 pages.
(Continued)

*Primary Examiner* — Derek J Battisti
(74) *Attorney, Agent, or Firm* — Merchant & Gould P.C.

(57) ABSTRACT

A recloseable zipper pouch includes a recloseable zipper with interlocking profiles. At least one of the profiles has a grasping flange with a free end positionable both above and below the interlocking profile, and an attachment flange below the interlocking profile and attached to the wall of the pouch at an anchored portion on the attachment flange. The grasping flange is unattached to the first wall between opposite sidewall edges of the pouch. The complementary interlocking profile is attached to the opposite pouch wall. Some pouches can also include an opening in a side wall of the pouch to provide access to a portion of the grasping flange.

11 Claims, 12 Drawing Sheets

Related U.S. Application Data application No. 16/226,245, filed on Dec. 19, 2018, now Pat. No. 11,286,086.

(56) References Cited

U.S. PATENT DOCUMENTS

| | | | | |
|---|---|---|---|---|
| 4,673,383 | A | 6/1987 | Bentsen | |
| 4,736,451 | A | 4/1988 | Ausnit | |
| 4,817,188 | A | 3/1989 | Van Erden | |
| 4,878,763 | A | 11/1989 | Ausnit | |
| 4,926,526 | A | 5/1990 | Brown et al. | |
| 5,007,143 | A | 4/1991 | Herrington | |
| 5,017,021 | A | 5/1991 | Simonsen et al. | |
| RE33,674 | E | 8/1991 | Uramoto | |
| 5,272,794 | A | 12/1993 | Hamatani et al. | |
| 5,558,613 | A | 9/1996 | Tilman et al. | |
| 5,564,834 | A | 10/1996 | Porchia et al. | |
| 5,672,009 | A | 9/1997 | Malin | |
| 5,711,609 | A | 1/1998 | Simonsen | |
| 5,832,145 | A | 11/1998 | Dais et al. | |
| 5,931,582 | A | 8/1999 | Nichols | |
| 5,972,396 | A | 10/1999 | Jurgovan et al. | |
| 6,004,032 | A | 12/1999 | Kapperman et al. | |
| 6,039,182 | A | 3/2000 | Light | |
| 6,149,302 | A | 11/2000 | Nossi | |
| 6,185,795 | B1 | 2/2001 | Shui-Shang | |
| 6,185,796 | B1 | 2/2001 | Ausnit | |
| 6,345,911 | B1 | 2/2002 | Young et al. | |
| 6,376,035 | B1 | 4/2002 | Dobreski et al. | |
| 6,385,818 | B1 | 5/2002 | Savicki | |
| 6,550,965 | B2 | 4/2003 | Shaffer et al. | |
| 6,733,178 | B2 | 5/2004 | Bois | |
| 7,029,178 | B2 | 4/2006 | Gzybowski | |
| 7,223,017 | B2 * | 5/2007 | Weaver | B65D 31/10 383/120 |
| 7,316,101 | B1 | 1/2008 | Nguyen et al. | |
| 7,437,805 | B2 | 10/2008 | Berich | |
| 7,494,280 | B2 | 2/2009 | Gzybowski | |
| 7,506,417 | B2 | 3/2009 | Yoneoka | |
| 7,674,039 | B2 | 3/2010 | Mcmahon et al. | |
| 7,784,160 | B2 | 8/2010 | Dais et al. | |
| 7,886,412 | B2 | 2/2011 | Dais et al. | |
| 8,066,434 | B2 * | 11/2011 | Nanba | B65D 33/2575 383/204 |
| 8,118,489 | B2 | 2/2012 | Waldron et al. | |
| 8,192,085 | B2 | 6/2012 | Pawloski et al. | |
| 8,550,716 | B2 | 10/2013 | Smith et al. | |
| 8,893,356 | B2 | 11/2014 | Ozaki et al. | |
| 9,011,003 | B2 | 4/2015 | Pawloski | |
| 9,022,003 | B2 | 5/2015 | Grover, Jr. et al. | |
| 9,284,097 | B2 | 3/2016 | Heckman | |
| 9,469,423 | B2 | 10/2016 | Thomas, Jr. et al. | |
| 9,573,730 | B2 | 2/2017 | Heckman | |
| 9,624,004 | B2 | 4/2017 | Kent et al. | |
| 9,957,087 | B2 | 5/2018 | Takigawa | |
| 9,969,534 | B2 | 5/2018 | Kent et al. | |
| 10,005,592 | B2 | 6/2018 | Takigawa | |
| 10,011,403 | B1 | 7/2018 | Kirsh | |
| 10,011,404 | B1 | 7/2018 | Kirsh | |
| 10,029,826 | B2 | 7/2018 | Petkovsek | |
| 10,093,458 | B2 | 10/2018 | Stave et al. | |
| 10,189,607 | B2 | 1/2019 | Tseng et al. | |
| 10,507,959 | B2 | 12/2019 | Kirsh | |
| 10,689,162 | B2 | 6/2020 | Tameda et al. | |
| 2002/0162200 | A1 | 11/2002 | Offa-Jones | |
| 2003/0014848 | A1 | 1/2003 | Larue et al. | |
| 2003/0138171 | A1 | 7/2003 | Kikuchi | |
| 2003/0167607 | A1 | 9/2003 | Linton | |
| 2003/0215163 | A1 * | 11/2003 | Schneider | B65D 33/2533 383/61.2 |
| 2004/0078939 | A1 | 4/2004 | Pawloski | |
| 2004/0161169 | A1 | 8/2004 | Fenzl et al. | |
| 2005/0196076 | A1 | 9/2005 | Tanaka et al. | |
| 2005/0286812 | A1 | 12/2005 | Sprague et al. | |
| 2006/0008186 | A1 | 1/2006 | Kusz | |
| 2006/0104550 | A1 | 5/2006 | Kuge et al. | |
| 2006/0111226 | A1 | 5/2006 | Anzini et al. | |
| 2006/0165316 | A1 | 7/2006 | Cheung | |
| 2006/0228055 | A1 | 10/2006 | Eads et al. | |
| 2007/0183692 | A1 * | 8/2007 | Pawloski | B65D 33/2566 383/61.2 |
| 2008/0232722 | A1 | 9/2008 | Pawloski et al. | |
| 2009/0067760 | A1 | 3/2009 | Shelley et al. | |
| 2010/0069211 | A1 | 3/2010 | Anzini et al. | |
| 2010/0150477 | A1 | 6/2010 | Bois | |
| 2010/0226599 | A1 | 9/2010 | Katada et al. | |
| 2010/0236026 | A1 | 9/2010 | Nanba et al. | |
| 2010/0290719 | A1 | 11/2010 | Yeager | |
| 2011/0103717 | A1 | 5/2011 | Kasai | |
| 2012/0189232 | A1 | 7/2012 | Anzini et al. | |
| 2013/0030550 | A1 | 1/2013 | Jopek et al. | |
| 2014/0161374 | A1 | 6/2014 | Septien Rojas et al. | |
| 2014/0259559 | A1 | 9/2014 | Vanloocke | |
| 2014/0270580 | A1 | 9/2014 | Thomas, Jr. et al. | |
| 2014/0270585 | A1 * | 9/2014 | Heckman | B65D 33/2508 383/63 |
| 2014/0270586 | A1 | 9/2014 | Petkovsek | |
| 2014/0311101 | A1 | 10/2014 | Petkovsek et al. | |
| 2014/0311102 | A1 | 10/2014 | Petkovsek et al. | |
| 2016/0088906 | A1 | 3/2016 | Jin | |
| 2016/0101904 | A1 | 4/2016 | Takigawa | |
| 2016/0122087 | A1 | 5/2016 | Takigawa | |
| 2016/0221723 | A1 | 8/2016 | Tseng et al. | |
| 2017/0152085 | A1 | 6/2017 | Septien Rojas et al. | |
| 2017/0190476 | A1 * | 7/2017 | Goto | B65D 33/2516 |
| 2017/0217650 | A1 | 8/2017 | Steele | |
| 2018/0044067 | A1 | 2/2018 | Septien-Rojas | |
| 2018/0118414 | A1 | 5/2018 | Martial | |
| 2018/0312301 | A1 | 11/2018 | Martial | |
| 2018/0312302 | A1 | 11/2018 | Septien Rojas et al. | |
| 2018/0319546 | A1 | 11/2018 | Liu | |
| 2018/0362220 | A1 | 12/2018 | Wang | |

FOREIGN PATENT DOCUMENTS

| | | | |
|---|---|---|---|
| EP | 1489019 | A1 | 12/2004 |
| EP | 2218650 | A1 | 8/2010 |
| EP | 3015395 | A1 | 5/2016 |
| EP | 3360815 | A1 | 8/2018 |
| GB | 841142 | A | 7/1960 |
| GB | 2424868 | A | 10/2006 |
| JP | 2001314207 | A | 11/2001 |
| JP | 2016043973 | A | 4/2016 |
| JP | 2017210258 | A | 11/2017 |
| PL | 64476 | Y1 | 6/2009 |
| WO | 2009089019 | A1 | 7/2009 |
| WO | 2014066025 | A1 | 5/2014 |
| WO | 2016034720 | A1 | 3/2016 |
| WO | 2017087359 | A1 | 5/2017 |
| WO | 2020137736 | A1 | 7/2020 |

OTHER PUBLICATIONS

Office Action for Chinese Patent Application No. 201980083968.6 dated Apr. 18, 2022, 12pgs.

* cited by examiner

HIDDEN FLANGE CHILD RESISTANT CLOSURE FOR RECLOSEABLE POUCH AND METHODS

This application is a continuation of application Ser. No. 16/851,866 filed Apr. 17, 2020 which is a continuation of application Ser. No. 16/550,872 filed Aug. 26, 2019 which is a continuation-in-part of application Ser. No. 16/226,245 filed Dec. 19, 2018, which is incorporated herein by reference in its entirety.

TECHNICAL FIELD

This disclosure relates to reclosable zipper pouch. More particularly, this disclosure relates to a reclosable zipper pouch that is child resistant.

BACKGROUND

A reclosable pouch having a press to close zipper closure is easy to open for children and adults. If the pouch is intended to have contents that are potentially harmful, there is a need to provide a closure and method to increase the difficulty for children to open the pouch and yet still be easy to open for adults and senior citizens.

SUMMARY

To improve the prior art, a reclosable package having a hidden flange is provided.

In one aspect, a reclosable package includes a first and second sidewall joined along respective side wall edges and a bottom to form a package with an open mouth. A reclosable zipper is positioned adjacent the mouth. The reclosable zipper includes a first track comprising an interlocking profile and a second track comprising a complementary interlocking profile. The first track includes a grasping flange with a free end positionable both above and below the interlocking profile and an attachment flange below the interlocking profile. The first track is attached to the first sidewall at an anchored portion on the attachment flange. The grasping flange is unattached to the first side wall between the sidewall edges. The second track is attached to the second sidewall.

In many arrangements, the grasping flange is part of a same, extruded member as the attachment flange.

In some embodiments, the grasping flange is part of a same, co-extruded member as the attachment flange.

In one or more embodiments, the grasping flange is a separate member secured to the attachment flange.

In one or more embodiments, the grasping flange is secured to the attachment flange below the interlocking profile.

In one or more embodiments, the grasping flange is secured to the attachment flange behind the interlocking profile.

In some examples, the first track includes a pair of interlocking profiles, and the second track includes a pair of complementary interlocking profiles. The grasping flange is secured to the attachment flange between each of the interlocking profiles of the first track.

In some embodiments, the second track further includes a second grasping flange with a free end positionable both above and below the complementary interlocking profile and a second attachment flange below the complementary interlocking profile. The second track is attached to the second side wall at an anchored portion on the second attachment flange. The second grasping flange is unattached to the second side wall between the side wall edges.

Some arrangements will include an opening in the first side wall sized to provide access to a portion of the grasping flange by one or more fingers from a position outside of the package.

Typically, the opening in the first side wall will be located spaced from the side wall edges and adjacent to the first track.

In many cases, the opening in the first side wall is located less than 3 mm from the grasping flange.

In example arrangements, the opening comprises one of slit, perforation, or gap in the first side wall.

In one or more embodiments, the first side wall includes a tab extending from a remaining portion of the first side wall, and a gap is between the tab and the remaining portion of the first side wall in communication with the opening.

In some examples, the tab is arch-shaped.

For some example implementations, a peak of the arch-shaped tab is closer to the open mouth than ends of the arch-shaped tab.

In some implementations, the ends of the arch-shaped tab are closer to the open mouth than a peak of the arch-shaped tab.

The tab may extend a distance of greater than 50% along the zipper closer between the side wall edges, in one or more arrangements.

In another aspect, a reclosable zipper pouch is provided. The pouch includes a surrounding wall having a closed bottom, first and second opposite sides, and first and second opposing wall panels between the first and second opposite sides. An open mouth is defined by terminal ends of the first and second opposing wall panels. The surrounding wall defines an interior volume therein. A reclosable zipper closure is between the terminal ends and the closed bottom. The zipper closure provides selective access to the interior volume through the mouth. The zipper closure includes: an attachment flange having an inner surface and an outer surface; a first zipper profile member secured to the outer surface of the attachment flange and extending toward the second wall panel; the attachment flange being secured to the first wall panel along only an anchored position of the inner surface and being free of attachment to the first wall panel at a region behind the first zipper profile member; a second zipper profile member secured to the second wall panel and extending toward the first wall panel and in a location to engage the first profile member; and the first and second profile members being constructed and arranged to selectively interlock when pressed together and unlocked when forced apart. An adjustable grasping flange is integral with the attachment flange and positionable between the attachment flange and the first wall. The grasping flange has a free end, a first surface, and an opposite second surface. The grasping flange is adjustable between a hidden position and a closure-opening position. The hidden position includes the free end being located between the attachment flange anchored portion and the first zipper profile member, and the first surface being adjacent the inner surface of the attachment flange; and the closure-opening position includes the first surface of the grasping flange pulled away from the inner surface of the attachment flange.

In many example embodiments, the closure-opening position includes the free end of the grasping flange extending toward the terminal ends of the mouth.

In some embodiments, the closure-opening position includes the free end of the grasping flange extending below the terminal ends of the mouth.

In some embodiments, the fixed portion of the grasping flange is part of a same extruded member as the attachment flange.

In some embodiments, the fixed portion of the grasping flange is part of a same co-extruded member as the attachment flange.

In some example embodiments, the grasping flange includes a fixed portion secured to the inner surface of the attachment flange, and the fixed portion of the grasping flange is not axially aligned with the first zipper profile member.

In one or more embodiments, the fixed portion of the grasping flange is located between the anchored portion and the first zipper profile member.

In one or more example embodiments, the attachment flange has a profile member and an opposite wall panel end. The zipper profile member is secured to the attachment flange adjacent the profile member end, and the attachment flange is secured to the first wall at the wall panel end at the anchored portion. The anchored portion extends along a length of less than half of the attachment flange from the wall panel end toward the profile member end.

In some implementations, the zipper closure further includes a third zipper profile member extending from the outer surface of the attachment flange and extending toward the second wall panel. The third zipper profile member is spaced from the first zipper profile member. A fourth zipper profile member extends from the second wall panel and extends toward the first wall panel and in a location to engage the third profile member. The fourth zipper profile member is spaced from the second zipper profile member.

In some examples, the fixed portion of the grasping flange is located between the first zipper profile member and the third zipper profile member.

In one or more example embodiments, the zipper closure further includes a second attachment flange having an inner surface and an outer surface. The second zipper profile member extends from the outer surface of the second attachment flange. The second attachment flange is secured to the second wall panel along only an anchored portion of the inner surface of the second attachment flange and is free of attachment to the second wall panel at a region behind the second zipper profile member. A second adjustable grasping flange is integral with the second attachment flange and is positionable between the second attachment flange and the second wall. The second grasping flange has a free end, a first surface, and an opposite second surface. The second grasping flange is adjustable between a hidden position and a closure-opening position. The hidden position of the second grasping flange includes the free end of the second grasping flange being located between the second zipper profile member and the second attachment flange anchored portion; and the first surface of the second grasping flange being adjacent the inner surface of the second attachment flange. The closure-opening position of the second grasping flange includes the first surface of the second grasping flange pulled away from the inner surface of the second attachment flange.

In some examples, the closure-opening position of the second grasping flange includes the free end of the second grasping flange extending toward the terminal ends of the open mouth.

In one or more embodiments, the closure-opening position of the second grasping flange includes the free end of the second grasping flange extending below the terminal ends of the open mouth.

In one or more examples, the second grasping flange is part of a same, extruded member as the second attachment flange.

In one or more examples, the second grasping flange is part of a same, co-extruded member as the second attachment flange.

In one or more examples embodiments, the second grasping flange includes a fixed portion secured to the inner surface of the second attachment flange, and the second grasping flange is located between the anchored portion of the second attachment flange and the second zipper profile member.

In some examples, the fixed portion of the second grasping flange is not axially aligned with the second zipper profile member.

In some examples, the first wall panel defines an opening sized to provide access to a portion of the grasping flange by one or more fingers from a positon outside of the zipper pouch.

The opening can be located in the first wall panel spaced from the first side and second side and adjacent to the first zipper profile.

In many examples, the opening is located less than 3 mm from the grasping flange.

In one or more embodiments, the opening comprises one of a slit, perforation, or gap in the first wall panel.

The first wall panel can include a tab extending from a remaining portion of the first wall panel, and a gap in communication with the opening is between the tab and a remaining portion of the first wall panel.

In many example embodiments, the tab is arch-shaped.

In embodiments that have an arch-shaped tab, a peek of the tab can be closer to the open mouth than terminal ends of the arch-shaped tab.

In other embodiments, terminal ends of the tab can be closer to the open mouth than a peak of the tab.

In many examples, the tab can extend a distance of greater than 50% along the zipper closure between the first side and second side of the first wall panel.

In another aspect, a method of opening a zipper closure of a reclosable zipper pouch is provided. The zipper closure has mating zipper profile members. The method includes a step of reaching into an interior of the pouch to grasp a first flange and then moving the first flange toward a mouth of the pouch. The method includes pulling the first flange in a direction away from an opposing second flange. The first flange and the opposing second flange are each secured to a mated zipper profile member. The method also includes the step of opening the zipper closure by pulling the first flange and the opposing second flange until the mating zipper profile members are disengaged.

In example methods, the step of moving the first flange includes unfolding the first flange to move a free end of the first flange toward a position adjacent a terminal end of the mouth of the pouch.

In one example embodiment, the method includes a step of reaching into the interior of the pouch to grasp the second flange and then move the second flange toward the mouth.

In some example methods, the step of moving the second flange includes unfolding the second flange to move a free end of the second flange toward a position adjacent a terminal end of the mouth of the pouch.

In example methods, the step of reaching into the interior of the pouch can include inserting one or more fingers through an opening in a side wall of the pouch to grasp the first flange.

The method can include a step of breaking one or more perforations in the side wall of the pouch to create a size in the opening to allow insertion of one or more fingers through the opening.

In example methods, the step of inserting one or more fingers includes inserting the one or more fingers under a tab in the side wall extending from a remaining portion of the side wall.

A variety of examples of desirable product features or methods are set forth in part in the description that follows, and in part will be apparent from the description, or may be learned by practicing various aspects of this disclosure. The aspects of the disclosure may relate to individual features as well as combinations of features. It is to be understood that both the foregoing general description and the following detailed description are explanatory only, and are not restrictive of the claimed invention.

DETAILED DESCRIPTION

A. Package Overview

Figure 1:
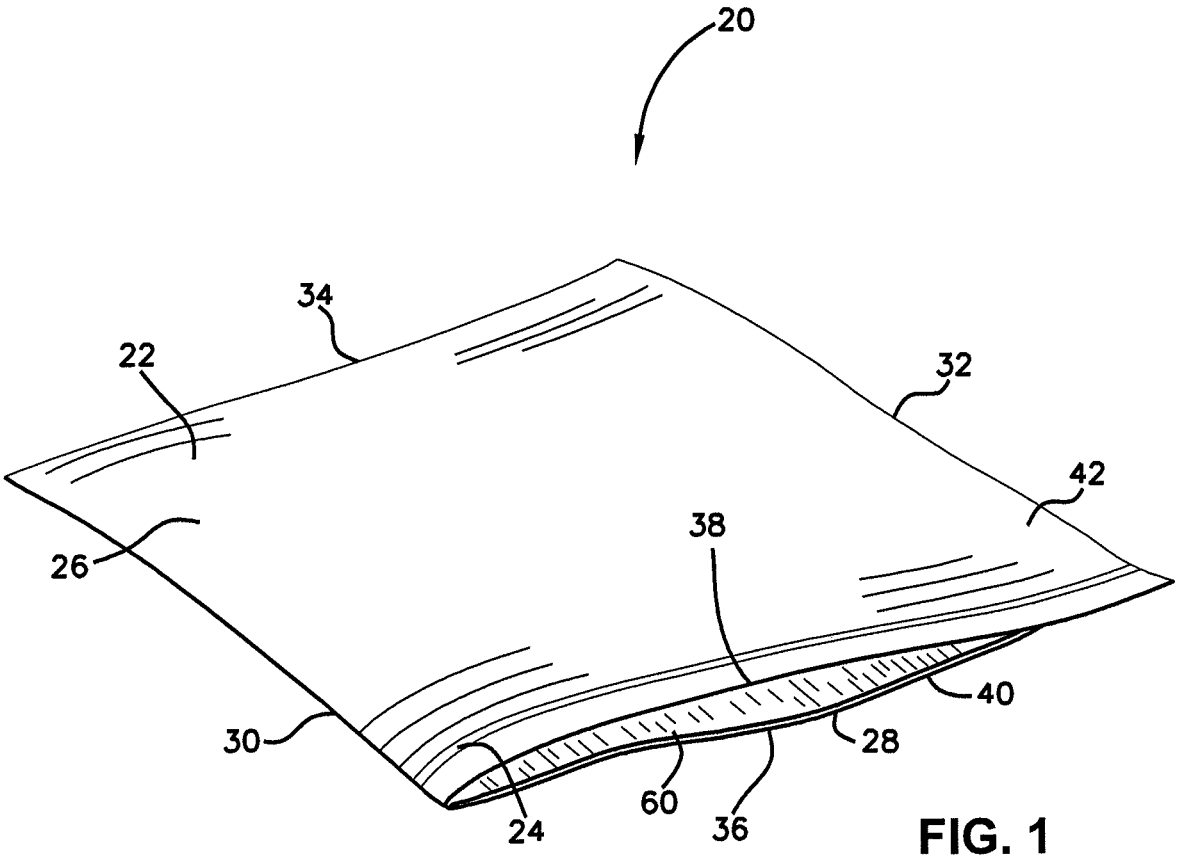
FIG. 1 is a schematic, perspective view of a reclosable pouch incorporating the zipper closure, constructed in accordance with principles of this disclosure.
Figure 2:
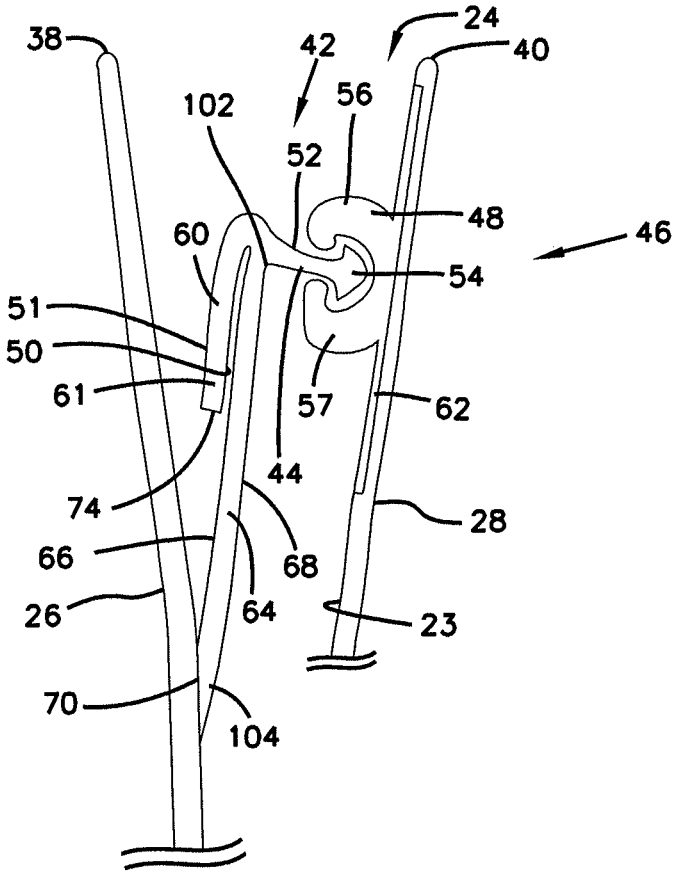
FIG. 2 is a schematic cross-sectional view of a portion of the reclosable pouch of FIG. 1 and showing a first embodiment of the zipper closure and depicting a grasping flange in a hidden position, constructed in accordance with principles of this disclosure.
Figure 3:
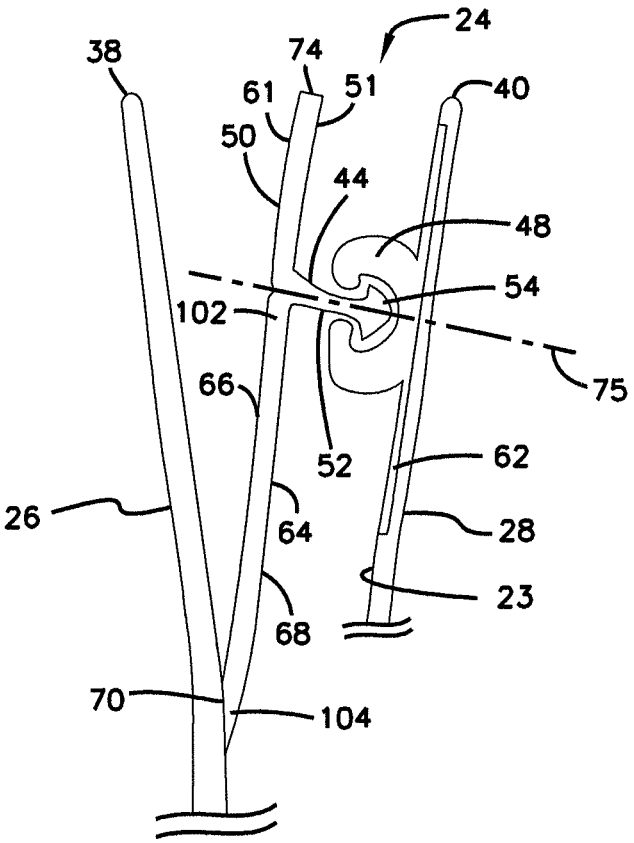
FIG. 3 is a schematic cross-sectional view of the zipper closure of FIG. 2, depicting the grasping flange in closure-opening position.

FIG. 1 illustrates a reclosable zipper package or pouch generally at 20. The pouch 20 will generally be flexible and can be made from a polymeric film, although other materials are usable. The pouch 20 includes a surrounding wall 22. The surrounding wall 22 encloses an interior volume 23 (FIG. 2). A reclosable zipper closure 24 is part of the pouch 20 to allow for selective closing and opening of the pouch 20 to either allow access to the interior volume 23 or block access to the interior volume 23. The materials of the zipper closure 24 are preferably polymer plastic and will typically be molded, such by an extrusion process.

The surrounding wall 22 includes first and second sidewalls or wall panels 26, 28 in opposition to each other. First and second sidewall edges (sides) 30, 32 join the first and second sidewalls 26, 28. In some embodiments, the first and second sidewall edges 30, 32 can be seals connecting together the first and second sidewalls 26, 28, while in other embodiments, the first and second sides 30, 32 are not seals, but merely form the sides 30, 32.

The pouch 20 includes a closed bottom 34. The closed bottom 34, in this embodiment, is between the first sidewall edge 30 and second sidewall edge 32 and at an opposite end of the pouch as the reclosable zipper closure 24. The closed bottom 34 can be part of the same single piece of material that forms the first wall 26 and second wall 28; alternatively, the closed bottom 34 can be a seal connecting together the first wall 26 and second wall 28.

Figure 4:
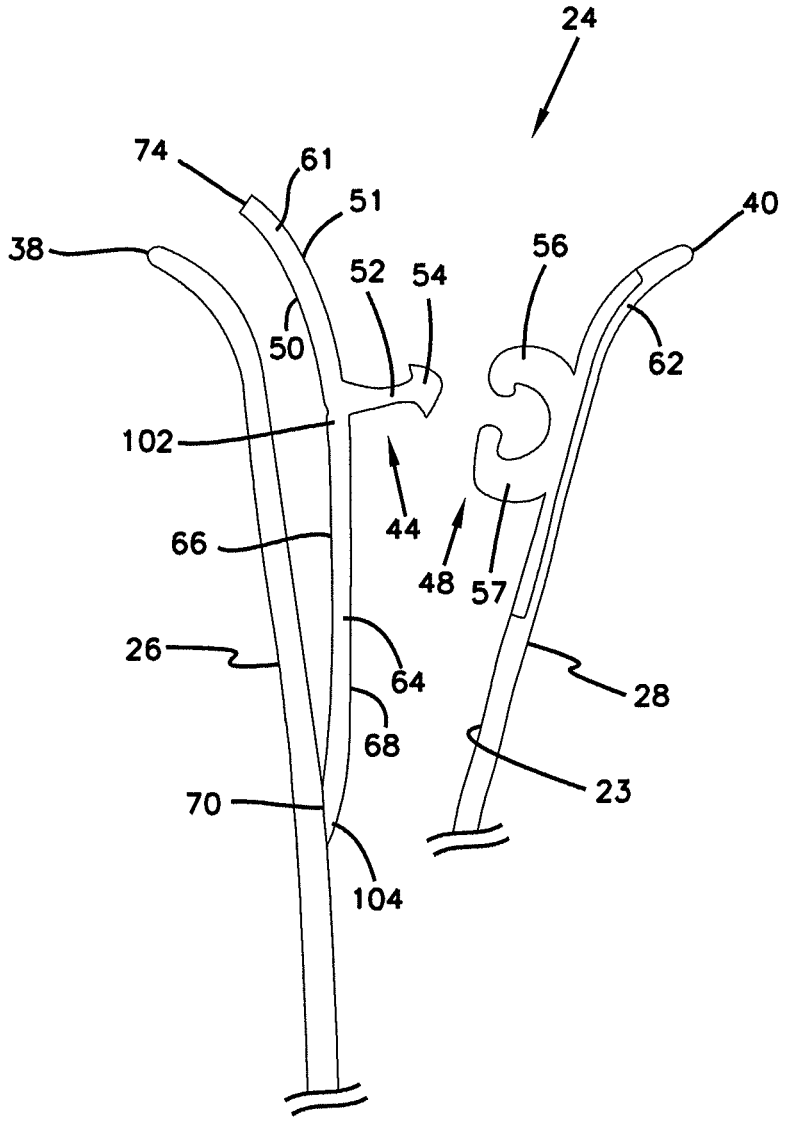
FIG. 4 is a schematic cross-sectional view of the zipper closure of FIGS. 2 and 3, depicting the zipper closure disengaged in an open position.

The pouch 20 has an open mouth 36 at the end of the pouch 20 that is opposite from the closed bottom 34. The mouth 36 is defined by terminal ends 38, 40 of the first and second walls 26, 28. The mouth 36 provides access to the interior volume 23, when the reclosable zipper closure 24 is in an unlocked/disengaged (open) position (FIG. 4). When the reclosable zipper closure 24 is in a locked position, access to the interior volume 23 is blocked.

The pouch 20 can be made from many different materials, and is preferably made from a polymeric material, such as a clear (transparent) polymer to form a flexible plastic bag.

B. Example Zipper Closures

The reclosable zipper closure 24 in the pouch 20 is constructed to increase the difficulty for children to open the pouch 20 and gain access to contents of the interior volume 23, while still allowing easy opening for adults or senior citizens. Example embodiments are shown in FIGS. 2-12. The same reference numerals will be used for analogous parts in these embodiments.

The reclosable zipper closure 24 is typically positioned adjacent the mouth 36. The zipper closure 24 includes a first track 42 having an interlocking profile in the form of a first zipper profile member 44.

The reclosable zipper closure 24 further includes a second track 46. The second track 46 has a complementary interlocking profile in the form of a second zipper profile member 48. The first profile member 44 and the second profile member 48 are constructed and arranged to selectively interlock when pressed together and unlock (see FIG. 4) when forced apart.

The first zipper profile member 44 and the second zipper profile member 48 have complementary shapes such that they will interlock or engage with each other in the form of a "press to fit" closure. While many different embodiments for such interlocking profiles are possible, in the example embodiment shown herein, the first zipper profile member 44 is in the form of a stem 52 having a head 54. The second zipper profile member 48 is in the form of a pair of legs 56, 57 with an opening therebetween. To engage the first zipper profile member 44 with the second zipper profile member 48, the head 54 is pushed between the legs 56, 57, which then hold the head 54 in place as the legs 56, 57 tuck under the head 54 and at the stem 52. Many different embodiments are possible.

The first track 42 further includes a first flange 60. As will be apparent from the description that follows, the first flange 60 operates as a grasping flange 61 because, in use to open the zipper closure 24, it is grasped. The first flange 60 has a free end 74 that is positionable both above the first profile member 44 and below the first profile member 44. By the term "above", it is meant that the free end 74 of the first flange 60 is positioned between the terminal ends 38, 40 defining the mouth 36 and the first zipper profile member 44.

The first track 42 further includes an attachment flange 64. The attachment flange 64 has an outer surface 68 facing the interior volume 23 of the pouch 20 and an opposite inner surface 66 facing the first side wall 26.

The first zipper profile member 46 projects from the outer surface 68 of the attachment flange 64. In many embodiments, the first zipper profile member 46 is a same extruded piece of material as the attachment flange 64.

The attachment flange 64 is secured to the first sidewall 26 only along an anchor portion 70. The anchor portion 70 will typically be located on the inner surface 66 of the attachment flange 64. The attachment flange 64 is free of attachment to the first wall panel 26 at a region behind the first zipper profile member 44. By the term "behind," it is meant the region of the attachment flange 64 that is in axial alignment with a longitudinal axis 75 (FIG. 3) of the first zipper profile member 44. In preferred embodiments, the attachment flange 64 is free of attachment to the first wall panel at all locations along the attachment flange 64 other than at the anchor portion 70.

The attachment flange 64 includes a profile member end 102 and an opposite wall panel end 104. The first zipper profile member 44 extends from the attachment flange 64 adjacent the profile member end 102. The attachment flange 64 is secured to the first wall panel 26 at the wall panel end 104 at the anchored portion 70. The anchored portion 70 extends along a length of less than half of the attachment flange 64 from the wall panel end 104 toward the profile member end 102. Many other variations are possible.

The second zipper profile member 48 is secured to the second wall panel 28 and extends toward the first wall panel 26 in a location to engage the first profile member 44. The second zipper profile member 48 can be part of a second flange 62, which is secured to the second wall panel 28 with a heat seal or adhesive.

The grasping flange 61 is integral with the attachment flange 64. By "integral with", it is meant that the grasping flange 61 is either the same, extruded or co-extruded piece of material as the attachment flange 64, or it is a separate piece of material that is permanently secured, attached, or fixed to the attachment flange 64. Various techniques for making the grasping flange 61 and attachment flange 64 are described in Section C, below.

As mentioned above, the grasping flange 61 has free end 74, which is unattached or free of any connection with the first side wall 26 between the sidewall edges 30, 32. In embodiments in which the grasping flange 61 is a separate piece of material that is secured to the attachment flange 64, the grasping flange 61 is completely unattached and free of connection with the first side wall 26, between the sidewall edges 30, 32. In preferred embodiments, the grasping flange 61 is secured at the sidewall edges 30, 32, and at those locations, the grasping flange 61 is attached to both the first side wall 26 and second side wall 28.

The grasping flange 61 has a first surface 50 and an opposite second surface 51. The free end 74 is at a terminal end of the grasping flange 61 between the first surface 50 and second surface 51.

In embodiments (i.e., FIGS. 5, 6, 9, 10) in which the grasping flange 61 is a separate piece of material that is secured to the attachment flange 64, the grasping flange 61 has a fixed portion 72 that is secured to the inner surface 66 of the attachment flange 64.

The grasping flange 61 is "adjustable." By the term "adjustable," it is meant that the grasping flange 61 is movable between a hidden position (FIG. 2) and a closure-opening position (FIGS. 3, 4, and 6-8, 10, 12). The hidden position includes the free end 74 being located between the first zipper profile member 44, and the attachment flange anchored portion 70. In embodiments (i.e., FIGS. 5, 6, 9, 10) having fixed portion 72, the hidden position can also be described as the free end 74 being located between the fixed portion 72 and the anchored portion 70. The hidden position includes the first surface 50 of the grasping flange 61 adjacent or against the inner surface 66 of the attachment flange 64.

In the closure-opening position, the first surface 50 of the grasping flange 61 is pulled away from the inner surface 66 of the attachment flange 64. In some embodiments (FIGS. 3, 4, 8, 10, 12), the closure-opening position includes the free end 74 located toward or adjacent the terminal end 38 of the first side wall 26. Those embodiments can also include the first profile member 44 being located axially between the free end 74 and the anchored portion 70.

Figure 8:
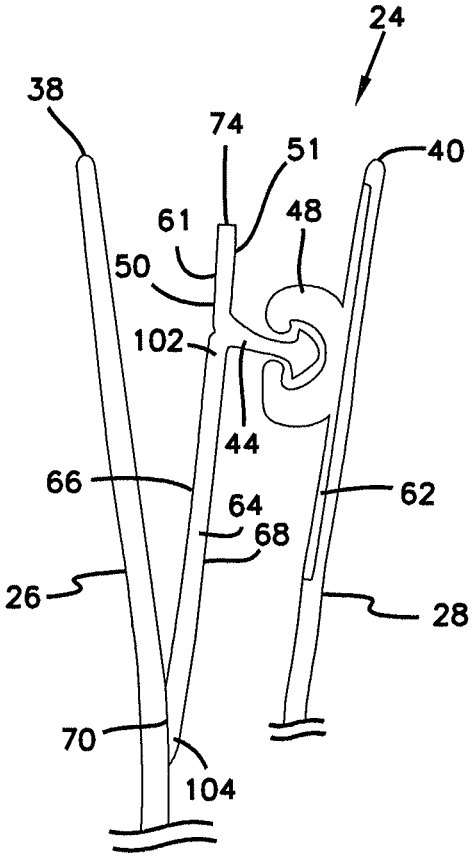
FIG. 8 is a schematic cross-sectional view of the zipper closure of FIG. 2 and showing a variation in a size of the grasping flange.

In FIG. 8, the free end 74 of the grasping flange 61 is below the terminal ends 38, 40 of the mouth 36 such that the free end 74 is located between the terminal ends 38, 40 and the first zipper profile member 44. In the configurations shown in FIGS. 3 and 6, the free end 74 is toward the terminal end 38, including being adjacent or even with the terminal ends 38, 40, when in the closure-opening position.

Figure 7:
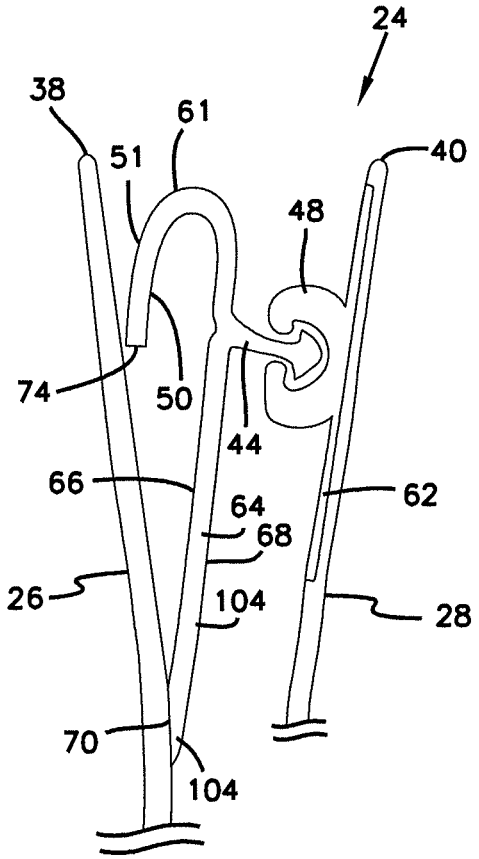
FIG. 7 is a schematic cross-sectional view of the zipper closure of FIG. 2 and showing a variation in a closure-opening position of the grasping flange.

FIG. 7 illustrates another possibility for the closure-opening position, in which the grasping flange 61 is pulled away from the inner surface 66 of the attachment flange, but the free end 74 remains lower than the first profile member 44. The grasping flange 61 can be pulled straight out from the first profile member 44 to open the closure 24.

When the materials of the first track 42 and second track 46 are made from a plastic polymer material, typically the anchored portion 70 between the attachment flange 64 and the bag side wall 26 is provided by either a heat seal, or an adhesive bond. Similarly, in embodiments (i.e., FIGS. 5, 6, 9, 10) in which the grasping flange 61 is a separate piece of material that is secured to the attachment flange 64, the fixed portion 72 of the grasping flange 61 is secured to the attachment flange 64 with either a heat seal or an adhesive bond.

In embodiments (i.e., FIGS. 5, 6, 9, 10) in which the grasping flange 61 is a separate piece of material that is secured to the attachment flange 64, the grasping flange 61 can be secured to the attachment flange 64 at many different configurations, described below.

Figure 5:
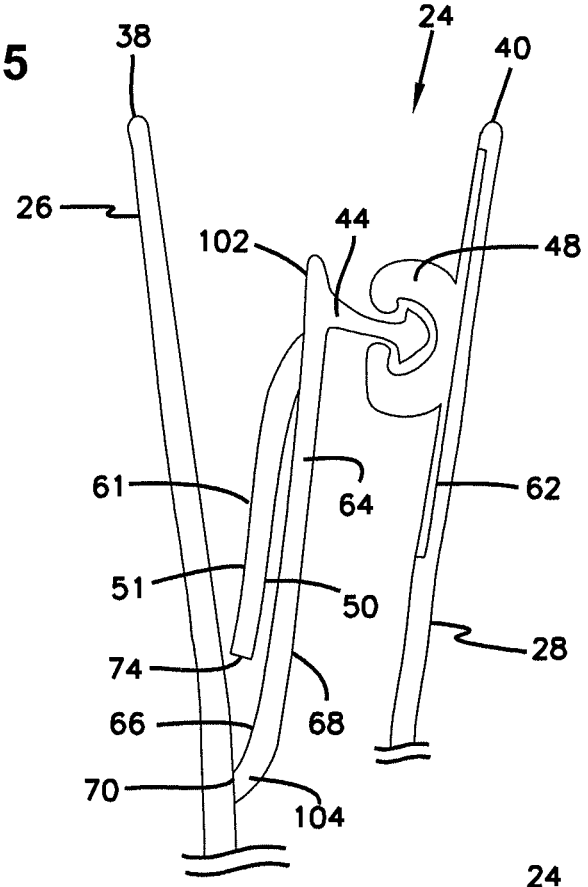
FIG. 5 is a schematic cross-sectional view of another embodiment of the zipper closure usable with the pouch of FIG. 1 and depicting the grasping flange in a hidden position.
Figure 6:
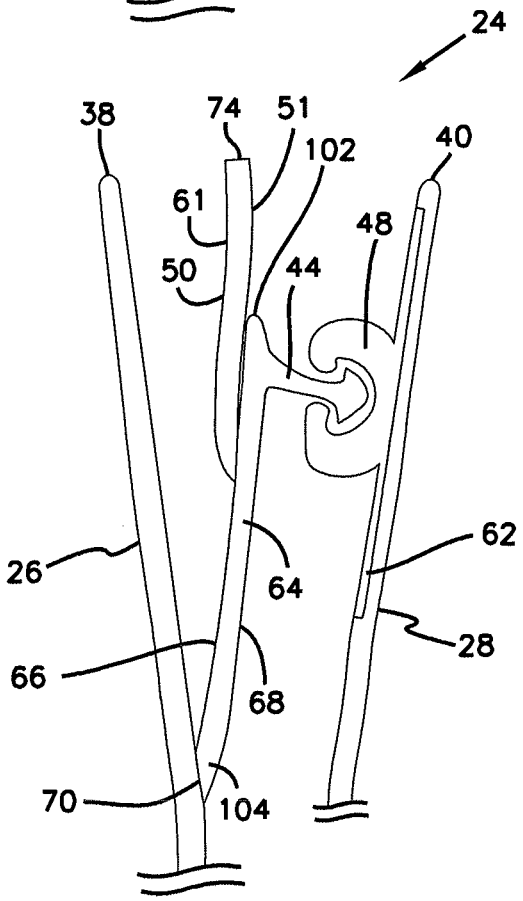
FIG. 6 is a schematic cross-sectional view of the zipper closure of FIG. 5, depicting the grasping flange in closure-opening position.

In the embodiment shown in FIGS. 5 and 6, the fixed portion 72 of the grasping flange 61 is not axially aligned with the first zipper profile member 44. In this embodiment, the grasping flange 61 is secured to the attachment flange 64 below the first zipper profile member 44 at a location between the first zipper profile member 44 and the anchored portion 70.

Figure 9:
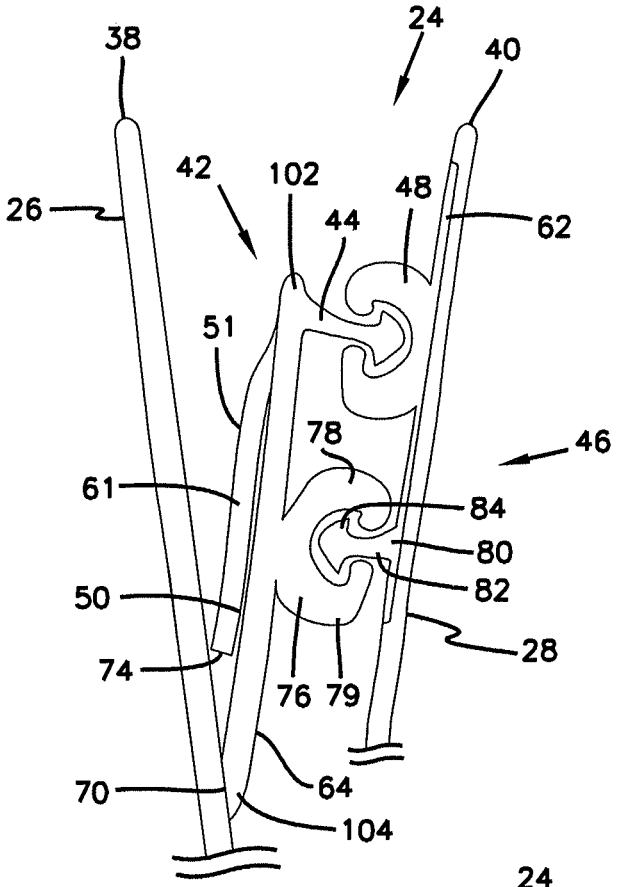
FIG. 9 is a schematic cross-sectional view of another embodiment of the zipper closure usable with the pouch of FIG. 1 and depicting the grasping flange in a hidden position.
Figure 10:
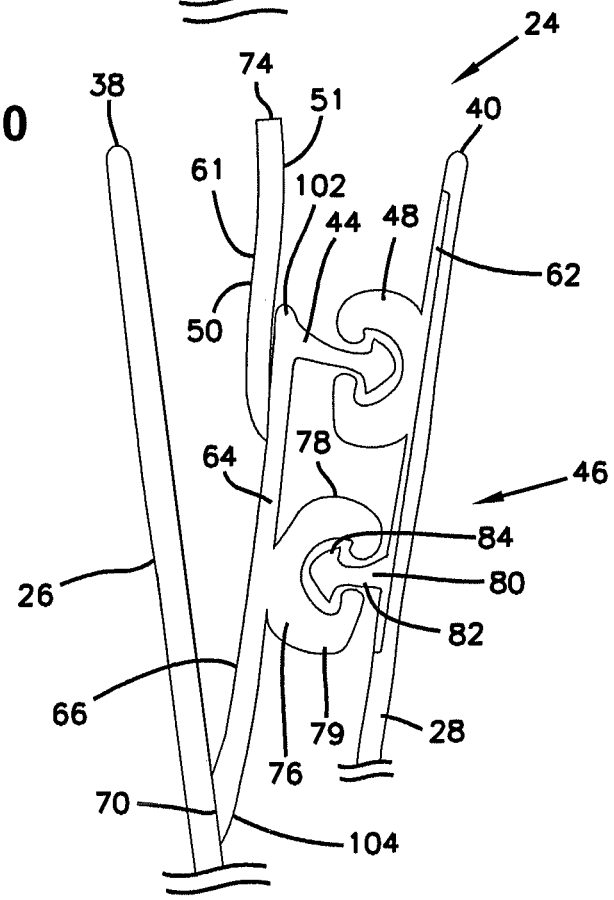
FIG. 10 is a schematic cross-sectional view of the zipper closure of FIG. 9, depicting the grasping flange in closure-opening position.

In the configuration of FIGS. 9 and 10, the first track 42 includes a pair of interlocking profiles, such that there is a third zipper profile member 76 secured to the outer surface 68 of the attachment flange 64 and extending toward the second wall panel 28. The third zipper profile member 76 is spaced from the first zipper profile member 44. In this embodiment, the third zipper profile member 76 includes a pair of spaced legs 78, 79.

Still in reference to FIGS. 9 and 10, the second track 46 includes a pair of complementary interlocking profiles. In particular, there is a fourth zipper profile member 80 secured to the second flange 62 and the second wall panel 28 and extending toward the first wall panel 26 and in a location to engage the third profile member 76. The fourth zipper profile member 80 is spaced from the second zipper profile member 48. In this embodiment, the fourth zipper profile member 80 is in the form of a stem 82 having a head 84. Many alternatives are possible.

In the embodiment of FIGS. 9 and 10, the fixed portion 72 of the grasping flange 61 is located or positioned between the first zipper profile member 44 and the third zipper profile member 76. Of course, the embodiment of FIGS. 9 and 10 can include other variations in which the fixed portion 72 of the grasping flange 61 is in axial alignment with either the first zipper profile member 44 or the third zipper profile member 76. Further, the grasping flange 61 can be extruded as a same piece of material as the attachment flange 64.

Figure 11:
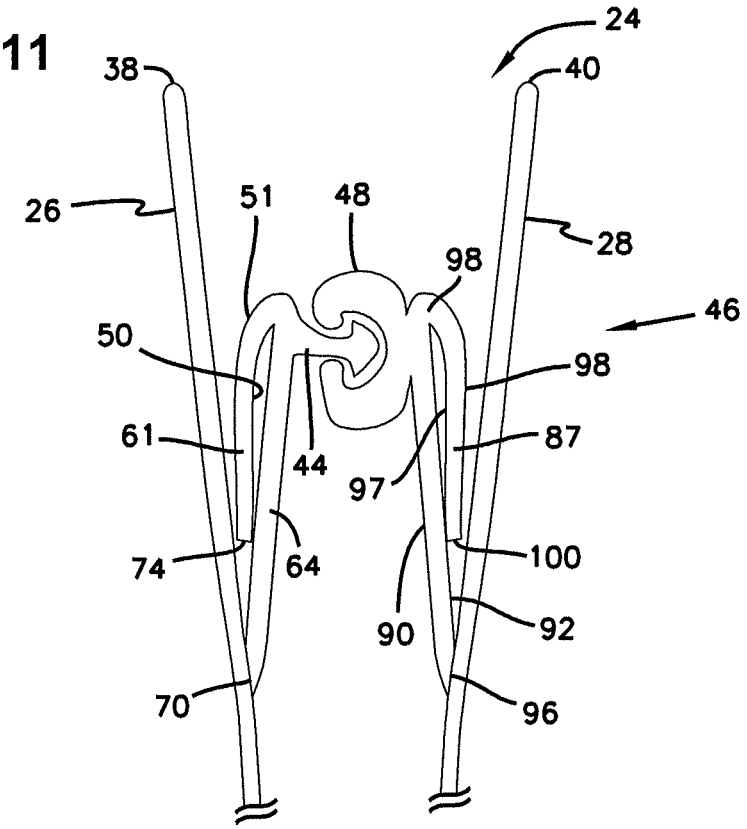
FIG. 11 is a schematic cross-sectional view of another embodiment of the zipper closure usable with the pouch of FIG. 1 and depicting the grasping flange in a hidden position.
Figure 12:
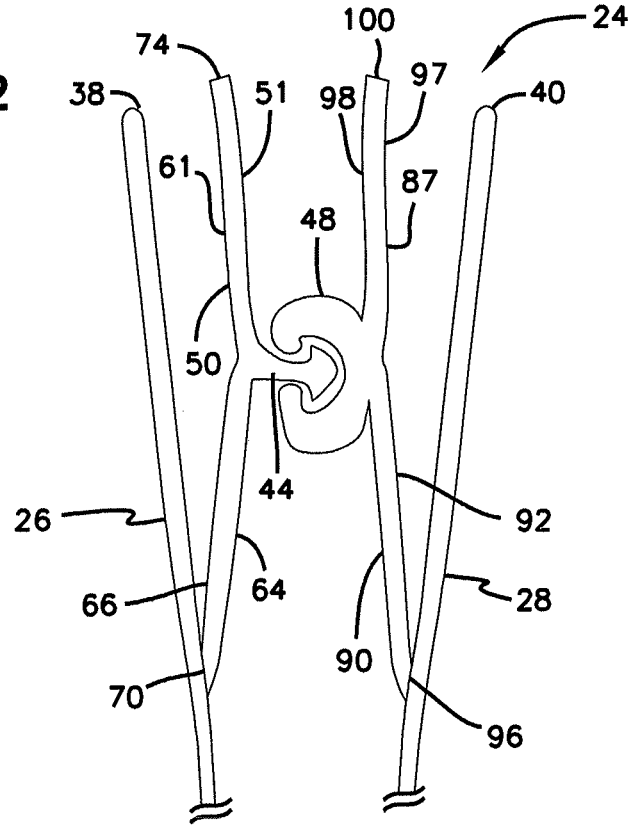
FIG. 12 is a schematic cross-sectional view of the zipper closure of FIG. 11, depicting the grasping flange in closure-opening position.

In reference now to the embodiment of FIGS. 11 and 12, the second track 46 can further include a second grasping flange 87 and a second attachment flange 90.

In particular, and still in reference to FIGS. 11 and 12, the second attachment flange 90 has an inner surface 92 and an outer surface 94. The second zipper profile member 48 extends from the outer surface 94 of the second attachment flange 90. The second attachment flange 90 is secured to the second wall panel 28 along only an anchored portion 96 of the inner surface 92 of the second attachment flange 90 and is free of attachment to the second wall panel 28 at a region behind the second zipper profile member 48.

The second grasping flange 87 is integral with the second attachment flange 90 and is positionable between the second attachment flange 90 and the second wall panel 28. In this embodiment, the second grasping flange 87 is shown a part of a same extruded member as the attachment flange 90. The second grasping flange 87 has a free end 100, a first surface 97, and an opposite second surface 98. The second grasping flange 87 is free of attachment to the second side wall 28 between the sidewall edges 30, 32. In preferred embodiments, the second grasping flange 87 is secured at the sidewall edges 30, 32, and at those locations, the second grasping flange 87 is attached to both the first side wall 26 and second side wall 28.

The second grasping flange 87 is adjustable between a hidden position and a closure-opening position. The hidden position is shown in FIG. 11. This position includes the free end 100 of the second grasping flange 87 being located between the second profile member 48 and the second attachment flange anchored portion 96. The hidden position includes the first surface 97 of the second grasping flange 87 adjacent or against the inner surface 92 of the second attachment flange 90.

In the closure-opening position, the first surface 97 of the second grasping flange 87 is pulled away from the inner surface 92 of the second attachment flange 90. In the embodiment shown in FIG. 12, the closure-opening position includes the free end 100 located toward or adjacent the terminal end 40 of the second side wall 28. The second profile member 48 is located axially between the free end 100 and the anchored portion 96.

In other embodiments, the second grasping flange 87 can be a separate piece of material that is secured, attached, or fixed to the attachment flange 90 at a fixed portion secured to the inner surface 92 of the second attachment flange 90, such as shown in FIGS. 5 and 6. As with the previous embodiments, when the second grasping flange 87 is a separate piece of material secured to the attachment flange 90, the fixed portion can be located in many different configurations including: in axial alignment with the second zipper profile member 48; or not in axial alignment with the second zipper profile member 48, such as in a position between the second zipper profile member 48 and the anchored portion 96, an example being shown in the embodiment of FIGS. 5 and 6.

It should also be appreciated that the inclusion of second attachment flange 90 and second grasping flange 87 can be incorporated into the embodiment of FIGS. 9 and 10 showing the double profiles for each track 42, 46.

The above arrangements can be used in a method of opening a zipper closure of a reclosable zipper pouch, such as the zipper closure 24 of reclosable zipper pouch 20. The method includes, first, reaching into the interior 23 of the pouch 20 to grasp first flange 60. The first flange 60 can be in the form of grasping flange 61. The step can include moving the first flange 60 toward the mouth 36 of the pouch 20.

The method can further include pulling the first flange 60 in a direction away from an opposing second flange 62. The first flange 60 and the opposing second flange 62 are each secured to a mated zipper profile member 44, 48, respectively.

The method can also include opening the zipper closure 24 by pulling the first flange 60 and the second flange 62 until the mating zipper profile members 44, 48 are disengaged.

The step of moving the first flange 60 includes unfolding the first flange 60 to move a free end 74 of the first flange 60 toward a position adjacent terminal ends 38, 40 defining the mouth 36 of the pouch 20.

The method may further include a step of reaching into the interior 23 of the pouch 20 to grasp a second grasping flange 87 and then moving the second grasping flange 87 toward the mouth 36.

The step of moving the second grasping flange 87 can include unfolding the grasping flange 87 to move a free end 100 of the second grasping flange 87 toward a position adjacent the terminal ends 38, 40 of the mouth 36 of the pouch 20.

C. Example Methods for Making the Grasping Flange and Attachment Flange

For any of the above embodiments, there are a variety of ways of attaching the grasping flange 61 to the remaining portion of the zipper profile, such as the attachment flange 64. These methods also apply to the grasping flange 87 and the attachment flange 90.

One method includes extruding the grasping flange as part of the zipper track 42, so that the extruded web includes: the attachment flange 64, the profile member 44, and the grasping flange 87. After extrusion, the grasping flange 87 is folded over.

Another method includes extruding the grasping flange as part of the zipper track 42, so that the extruded web includes: the attachment flange 64, the profile member 44, and the grasping flange 87, but in this case, the grasping flange 87 is extruded at an angle toward the attachment flange anchor portion 70. Because the grasping flange 87 is extruded at the angle, there is no need to fold the grasping flange.

Another method includes co-extruding the grasping flange with the rest of the zipper track 42. The extruded web includes: the attachment flange 64 and the profile member 44, while the grasping flange 87 is co-extruded at an angle toward the attachment flange anchor portion 70.

Another method includes making the grasping flange 87 as a separate piece from the rest of the zipper track 42 (attachment flange 64 and profile member 44) and then heat sealing the grasping flange 87 to the attachment flange 64 at an angle toward the attachment flange anchor portion 70.

Another method includes making the grasping flange 87 as a separate piece from the rest of the zipper track 42 (attachment flange 64 and profile member 44) and then adhesively bonding the grasping flange 87 to the attachment flange 64 at an angle toward the attachment flange anchor portion 70.

D. The Embodiments of FIGS. 13-19

FIGS. 13-19 depict additional embodiments of the reclosable zipper pouch or package shown here at reference numeral 120. The features previously described that are in common with the package 20 of FIGS. 1-12 will have the same reference numerals, and will not be again described here. Rather, the descriptions of those features are incorporated herein by reference.

The package 20 of FIGS. 1-12 is useful for being child-resistant. However, in some instances, it may be difficult for large fingers or for the elderly to easily open the package 20 of FIGS. 1-12. To address this problem, the solutions of FIGS. 13-19 are provided.

Figure 13:
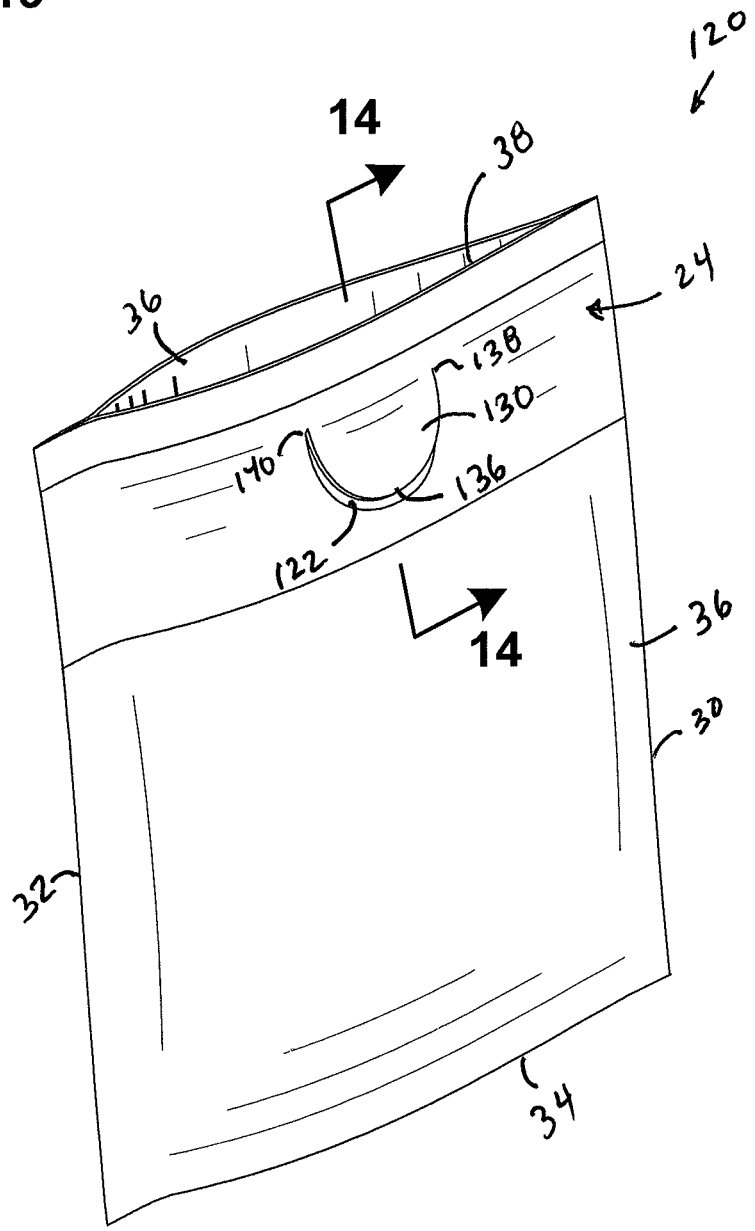
FIG. 13 is a perspective view of a reclosable pouch and including an opening in the pouch to provide access to a portion of the grasping flange, according to another embodiment of this disclosure.

FIG. 13 illustrates the package 120 with the child-resistant zipper closure 24 as previously described. In this embodiment, the package 20 further includes an opening 122 through the first sidewall 26. The opening 122 is sized to provide access to at least a portion of the grasping flange 61 by one or more fingers from a position outside of the package 120.

Figure 14:
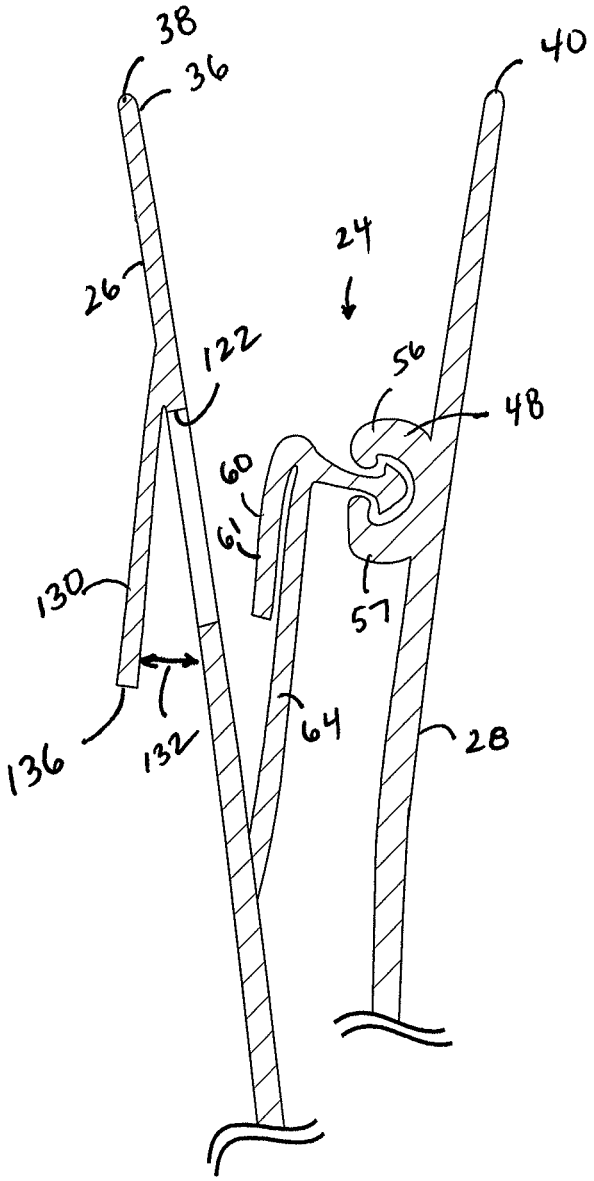
FIG. 14 is a cross-sectional view of a portion of the pouch of FIG. 13, the cross section being taken along the line 14-14 of FIG. 13.

FIG. 14 shows a cross-sectional view of the package 120 in the region of the opening 122 and zipper closure 24. The opening 122 is spaced in the vicinity of the zipper closure 24 and adjacent to but spaced from the terminal end 36 of the first sidewall 30. The opening 122 is spaced adjacent to the mouth 36 and within the first sidewall 30 spaced from the terminal end 38 defining the mouth 36.

In the example shown in FIG. 14, the opening 122 is directly over in covering relation to the grasping flange 61. In general, it is convenient if the opening 122 is located at or near the grasping flange 61, such as less than 3 mm from the grasping flange 61.

The opening 122 is spaced from the sidewall edges 30, 32. The opening 122 can be positioned anywhere between the side edges 30, 32. In the example shown in FIG. 13, the opening 122 is centered between the side edges 30, 32.

Figure 18:
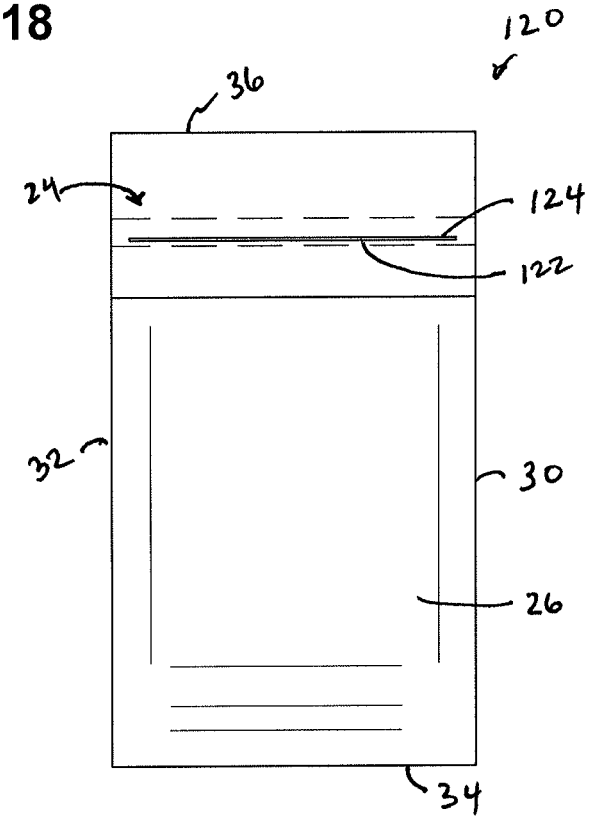
FIG. 18 is a front elevational view, similar to the view of FIG. 15, but illustrating another embodiment.

The opening 122 can be embodied in many different ways. For example, the opening 122 can be in the form of a slit 124 (FIG. 18) in the first sidewall 26. The slit 124 is a long opening within the first sidewall 26 and may extend a distance of greater than 50% of the length along the zipper closure 24 between the sidewall edges 30, 32. In FIG. 18, the slit 124 extends almost the entire distance between the edges 30, 32, including greater than 75% of the distance of the zipper closure 24 and less than 99% of the distance of the zipper closure 24.

Figure 19:
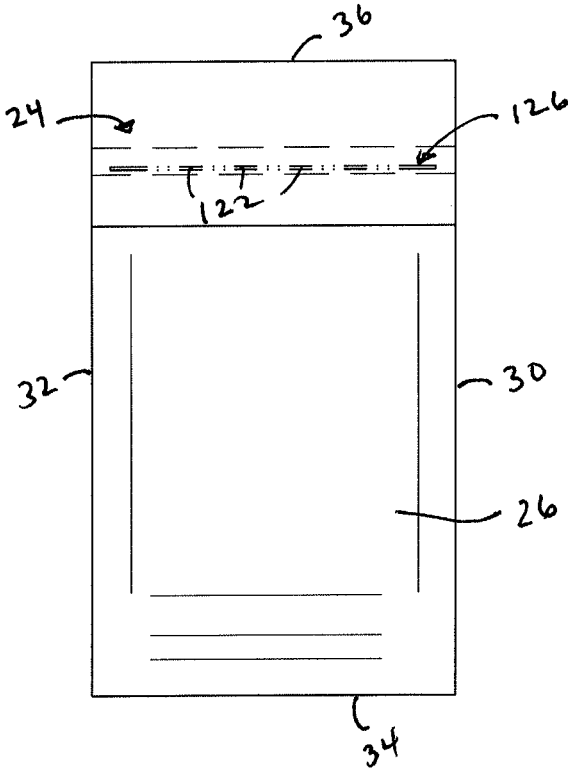
FIG. 19 is a front elevational view, similar to the view of FIG. 15, but illustrating another embodiment.

The opening 122 can also be in the form of a perforation 126 (FIG. 19). The perforation 126 includes a row of openings 122 separated by sections of the first sidewall 26 that do not include openings. The row of openings 122 forming the perforation 126 can extend a variety of lengths compared to the length of the zipper closure 24. For example, in the embodiment depicted in FIG. 19, the perforation 126 is greater than 50% of the length of the zipper closure 24; indeed, greater than 75% of the length of the zipper closure 24, and can extend between 80-99% of the length of the zipper closure 24. To access the grasping flange 61, the user would transform the perforation 126 into a larger opening by breaking the first sidewall 26 between the adjacent openings 122.

In the embodiment of FIGS. 13-17, the first side wall 26 includes a tab 130. The tab 130 extends from a remaining portion of the first side wall 26 and forms a gap 132 between the tab 130 and the first side wall 26. The gap 132 is in communication with the opening 122.

The tab 130 can include various shapes including rectangular (FIG. 17), irregular, polygon, rounded, or arch-shaped (FIGS. 13-16). Many other shapes are possible.

Figure 15:
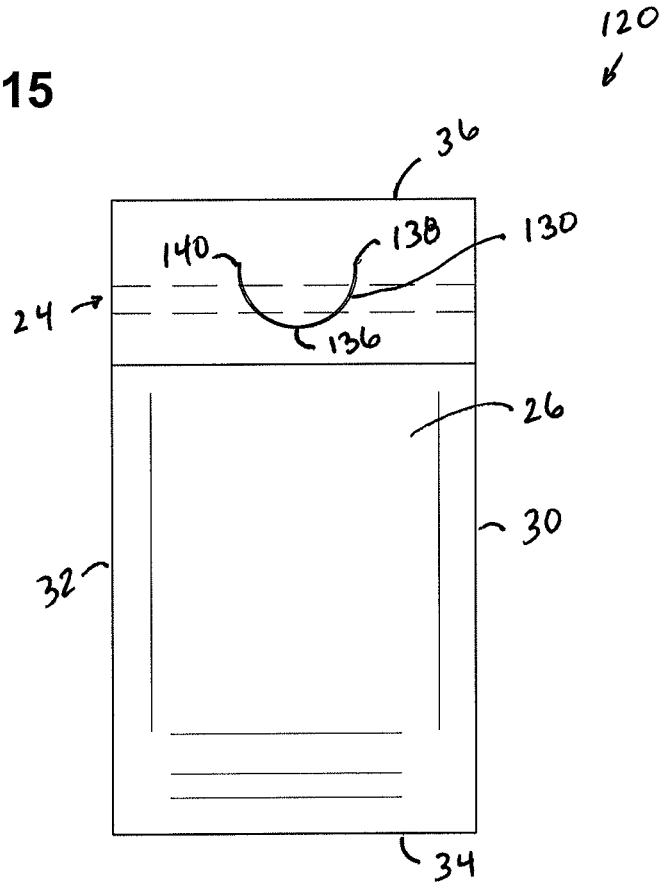
FIG. 15 is a front elevational view of the pouch of FIG. 13.

In the example shown in FIGS. 13 and 15, the tab 130 is arch-shaped in which the peak 136 is spaced farther from the mouth 36 of the package 120 than the ends 138, 140 of the arch-shape. That is, the ends 138, 140 of the tab 130 are closer to the mouth 36 than the peak 136. When the package 120 is in an upright position with the mouth 36 at the most upright position, the tab 130 forms a smile-shape.

Figure 16:
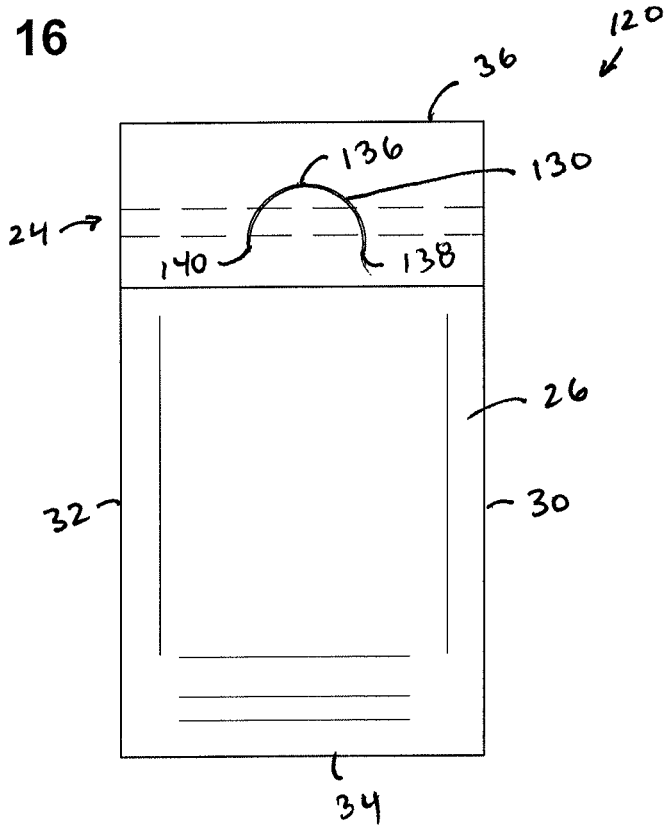
FIG. 16 is a front elevational view, similar to the view of FIG. 15, but illustrating another embodiment.

The arch-shaped tab 130 could also be oriented in the direction shown in FIG. 16, in which the peak 136 is closer to the mouth 36 than the ends 138, 140. When the package 120 is oriented in an upright position with the mouth 36 at the upper most position, the arch-shaped tab 130 in FIG. 16 forms a frown-shape.

Figure 17:
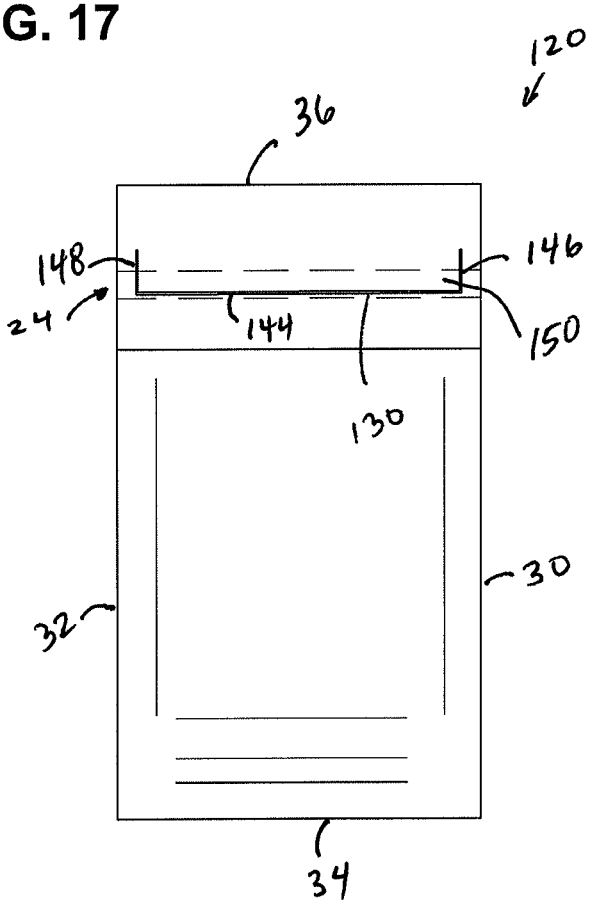
FIG. 17 is a front elevational view, similar to the view of FIG. 15, but illustrating another embodiment.

In the embodiment of FIG. 17, the tab 130 is generally rectangular having an edge 144, illustrated here as a straight edge 144, extending between a pair of sides 146, 148. The tab 130 in FIG. 17 forms a rectangular flap 150, extending a distance of greater than 50% along the zipper closure 24. In the FIG. 17 example, the flap 150 extends greater than 75% and less than 99% of the length of the zipper closure 24. While in this embodiment the straight edge 144 is spaced farther from the mouth 36 than ends of the sides 146, 148, in other embodiments, the direction of the flap 150 could be reversed, in which the straight edge 144 was closer to the mouth 36 than ends of the sides 146, 148. It should be understood that the edge 144, although depicted as being straight, could be any number of geometric variations including curved, zig-zagged, or irregular.

The opening 122 can also be used in embodiments that have second grasping flange 87 as shown in FIGS. 11 and 12. In those embodiments, the package 120 would include an opening 122 in both the first side wall 26 as well as the second side wall 28. The opening in the second side wall 28 would allow the user to access the second grasping flange 87, in a manner analogous to how the grasping flange 61 is accessed through the first sidewall 26.

The embodiments of FIGS. 13-19 can be used in a method of opening a zipper closure of a reclosable zipper pouch, such as the zipper closure 24 of the reclosable zipper pouch 120. As describe above in connection with the embodiment of FIGS. 1-12, the method includes reaching into the interior 23 of the pouch 120 to grasp the grasping flange 61.

The step of reaching into the interior 23 of the pouch 120 may include inserting one or more fingers through the opening 122 in the first side wall 26 of the pouch 120 to grasp the first flange 60, which can be in the form of the grasping flange 61.

When the opening 122 is in the form of perforations 126, the method can include breaking one or more of the perforations 126 in the first side wall 26 to create a size in the opening 122 to allow insertion of one or more fingers through the opening 122.

In embodiments in which the package 120 includes tab 130, the step of inserting one or more fingers can include inserting the one or more fingers under the tab 130 in the first side wall 26, such that the fingers enter the gap 132 and penetrate the opening 122 in order to access the grasping flange 61.

The above description represents example principles of this disclosure. Many embodiments can be made applying these principles.

What is claimed is:

1. A recloseable package comprising:

(a) a first and second sidewall joined along respective sidewall edges, and a bottom to form a package with an open mouth bounded by terminal ends of the first and second sidewalls; and (b) a recloseable zipper closure positioned adjacent the mouth, comprising:

(i) a first track comprising an interlocking profile, the first track further comprising an attachment flange integral with a grasping flange, wherein the grasping flange is unattached to the first sidewall between the sidewall edges, and the attachment flange is attached to the first sidewall at a first region extending between the sidewall edges and free of attachment to the first sidewall at a second region vertically displaced from the first region, wherein the second region is at a region behind the interlocking profile; and (ii) a second track comprising a complementary interlocking profile, the second track attached to the second sidewall;

(c) wherein the grasping flange has a free end below the terminal ends such that the free end is located between the terminal ends and the first track interlocking profile; and wherein the grasping flange is freely movable and unattached to the first sidewall a complete distance between the sidewall edges, and unattached to the first sidewall between the free end and at least the first track interlocking profile; and (d) wherein, when the package is in a closed condition with the interlocking profiles mated, a surface of the grasping flange is positioned to be opposing and movable to be directly against a surface of the attachment flange.

2. The recloseable package of claim 1 wherein the grasping flange unfolds from a first position in which the free end is located between the terminal ends and the first track interlocking profile to a second position where the free end is located adjacent the terminal end of the first sidewall.

3. The recloseable package of claim 1 wherein the grasping flange is part of a same, extruded member as the attachment flange.

4. The recloseable package of claim 1 wherein the grasping flange is part of a same, co-extruded member as the attachment flange.

5. The recloseable package of claim 1 wherein:

(a) the interlocking profile on the first track comprises a stem with a head; and (b) the interlocking profile on the second track comprises a pair of legs spaced apart to receive the head of the first track.

6. The recloseable package of claim 1 wherein the grasping flange is movable away from the attachment flange.

7. The recloseable package of claim 1 wherein the attachment flange is secured to the first sidewall only along an anchor portion on an inner surface of the attachment flange.

8. The recloseable package of claim 7 wherein the anchor portion comprises a heat seal between the attachment flange and the first sidewall.

9. The recloseable package of claim 7 wherein the anchor portion comprises an adhesive bond between the attachment flange and the first sidewall.

10. The recloseable package of claim 1 wherein the zipper closure comprises a plastic polymer material.

11. A recloseable package comprising:

(a) a first and second sidewall joined along respective sidewall edges, and a bottom to form a package with an open mouth bounded by terminal ends of the first and second sidewalls; and (b) a recloseable zipper closure positioned adjacent the mouth, comprising:

(i) a first track comprising an interlocking profile, the first track further comprising an attachment flange integral with a grasping flange, wherein the grasping flange is unattached to the first sidewall between the sidewall edges, and the attachment flange is attached the first sidewall at a first region extending between the sidewall edges and free of attachment to the first sidewall at a second region vertically displaced from the first region, wherein the second region is at a region behind the interlocking profile; and (ii) a second track comprising a complementary interlocking profile, the second track attached to the second sidewall;

(c) wherein the grasping flange has a free end below the terminal ends such that the free end is located between the terminal ends and the first track interlocking profile; and wherein the grasping flange is freely movable and unattached to the first sidewall a complete distance between the sidewall edges, and unattached to the first sidewall between the free end and at least the first track interlocking profile; and (d) wherein the first track includes a fold along the complete distance between the sidewall edges such that a surface of the grasping flange is opposing and is positionable to be directly against a surface of the attachment flange when the package is in a closed condition.

* * * * *